US007768486B2

(12) United States Patent
Park et al.

(10) Patent No.: US 7,768,486 B2
(45) Date of Patent: Aug. 3, 2010

(54) ORGANIC LIGHT EMITTING DISPLAY AND METHOD OF DRIVING THE SAME

(75) Inventors: Young Jong Park, Seoul (KR); Jae Sung Lee, Seoul (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 1126 days.

(21) Appl. No.: 11/404,483

(22) Filed: Apr. 13, 2006

(65) Prior Publication Data

US 2006/0244387 A1 Nov. 2, 2006

(30) Foreign Application Priority Data

Apr. 28, 2005 (KR) ..... 10-2005-0035772

(51) Int. Cl.
*G09G 3/30* (2006.01)

(52) U.S. Cl. ..... 345/77; 345/82; 345/207

(58) Field of Classification Search ..... 345/76–83, 345/102, 204, 207; 315/169.1–169.4
See application file for complete search history.

(56) References Cited

U.S. PATENT DOCUMENTS 7,053,412 B2 * 5/2006 Hack et al. ..... 257/79

(Continued)

FOREIGN PATENT DOCUMENTS

| | | |
|---|---|---|
| JP | 59-181882 A | 10/1984 |
| JP | 11-24631 | 1/1999 |
| JP | 2000-221944 | 8/2000 |
| JP | 2001-134237 A | 5/2001 |

(Continued)

OTHER PUBLICATIONS

Japan Office Action dated Nov. 25, 2008 for corresponding Japanese Application No. 2005-340889, noting listed references in this IDS.

(Continued)

*Primary Examiner*—Kimnhung Nguyen
(74) *Attorney, Agent, or Firm*—Christie, Parker & Hale, LLP

(57) ABSTRACT

An organic light emitting display capable of reducing power consumption and controlling brightness in response to the intensities of peripheral light. The organic light emitting display includes a data driver for supplying data signals to data lines, a scan driver for sequentially supplying scan signals to scan lines and sequentially supplying emission control signals to emission control lines, a display region including a plurality of pixels for receiving the data signals, the scan signals and the emission control signals to display images and a brightness controller for controlling the brightness of the display region. The brightness controller controls the brightness of the display region in response to the data of one frame and the intensities of peripheral light. This system reduces power consumption, controls the brightness of the display region in response to the intensities of the peripheral light and improves the contrast of the display region.

15 Claims, 11 Drawing Sheets

U.S. PATENT DOCUMENTS

| | | | | |
|---|---|---|---|---|
| 7,106,285 | B2 * | 9/2006 | Naugler | 345/87 |
| 7,239,309 | B2 * | 7/2007 | Smith et al. | 345/207 |
| 7,271,378 | B2 * | 9/2007 | Cok | 250/214 AL |
| 2004/0155593 | A1 | 8/2004 | Kim et al. | |
| 2004/0164938 | A1 | 8/2004 | Choi et al. | |
| 2005/0128193 | A1 * | 6/2005 | Lueder | 345/207 |

FOREIGN PATENT DOCUMENTS

| | | | |
|---|---|---|---|
| JP | 2003-338372 | A | 11/2003 |
| JP | 2004-361816 | A | 12/2004 |
| JP | 2005-055726 | A | 3/2005 |
| KR | 2000-0033177 | | 6/2000 |
| KR | 2001-0096760 | | 11/2001 |
| KR | 2002-0094601 | | 12/2002 |
| KR | 2004-0069066 | | 8/2004 |
| WO | WO 2004/023446 | A1 | 3/2004 |

OTHER PUBLICATIONS

Patent Abstracts of Japan, Publication No. 11-024631; Publication Date: Jan. 29, 1999; in the name of Hosoi et al.

SIPO Office action issued Jun. 6, 2008, for China Patent Application No. 200610079980.4, with English translation indicating relevance of listed references in this IDS.

Patent Abstracts of Japan, Publication No. 2000-221944, dated Aug. 11, 2000, in the name of Koji Ogusu et al.

Korean Patent Abstracts, Publication No. 1020000033177 A, dated Jun. 15, 2000, in the name of Hak Su Kim et al.

* cited by examiner

FIG. 6

413

| VALUES OF UPPER 5 BITS (CONTROL DATA) | EMISSION RATE | EMISSION RATIO | BRIGHTNESS | THE FIRST WIDTHS OF A EMISSION CONTROL SIGNAL (NUMBER OF Hsync) |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | – | – | – | – |
| 29 | – | – | – | – |
| 30 | – | – | – | – |
| 31 | – | – | – | – |

423

| MODE | CHANGE VALUE (Wd) (NUMBER OF Hsync) |
|---|---|
| 0 (VERY DARK) | 30 |
| 1 ( DARK ) | 20 |
| 2 ( INDOOR ) | 10 |
| 3 ( OUTDOOR ) | 0 |

423

| MODE | CHANGE VALUE(Wd) (RATIO) |
|---|---|
| 0 (VERY DARK) | 0.7 |
| 1 ( DARK ) | 0.8 |
| 2 ( INDOOR ) | 0.9 |
| 3 ( OUTDOOR ) | 1.0 |

ORGANIC LIGHT EMITTING DISPLAY AND METHOD OF DRIVING THE SAME

CROSS-REFERENCE TO RELATED APPLICATIONS

This application claims priority to and the benefit of Korean Patent Application No. 10-2005-0035772, filed on Apr. 28, 2005, in the Korean Intellectual Property Office, the entire content of which is incorporated herein by reference.

BACKGROUND

1. Field of the Invention

The embodiments of the present invention relate to an organic light emitting display and a method of driving the same. More specifically, the embodiments of the present invention relate to an organic light emitting display capable of reducing power consumption and of controlling brightness in response to the intensities of peripheral light and a method of driving the same.

2. Discussion of Related Art

Light emitting displays are generally divided into organic light emitting displays using organic light emitting diodes (OLED) and inorganic light emitting displays using inorganic light emitting diodes. OLEDs include anode electrodes, cathode electrodes and an organic emission layer positioned between the anode electrodes and the cathode electrodes to emit light by the combination of electrons and holes. The inorganic light emitting diode, referred to as a light emitting diode (LED), includes an emission layer formed of inorganic material such as a PN-junction semiconductor unlike the OLED.

FIG. 1 illustrates the structure of a conventional organic light emitting display.

Referring to FIG. 1, the conventional organic light emitting display includes a display region 10, a data driver 20 and a scan driver 30.

The display region 10 is composed of a plurality of pixels 11 each of which includes an OLED (not shown). The pixels 11 are formed in the regions partitioned by scan lines S1 to Sn and data lines D1 to Dm. The display region 10 receives a first power source ELVdd and a second power source ELVss from the outside. Each of the pixels 11 receives a scan signal, a data signal, the first power source ELVdd, and the second power source ELVss to display an image.

The data driver 20 generates data signals. The data signals generated by the data driver 20 are supplied to the data lines D1 to Dm in synchronization with scan signals to be transmitted to the pixels 11.

The scan driver 30 generates scan signals. The scan signals generated by the scan driver 30 are sequentially supplied to the scan lines S1 to Sn.

According to the conventional organic light emitting display having the above structure, the larger the number of pixels 11 that emit light is, the larger the amount of current that flows to the display region 10 is. In particular, the larger the number of pixels 11 that display high grayscale values among the pixels 11 that emit light is, the larger the amount of current that flows to the display region 10 is. Therefore, power consumption increases. Also, in the conventional organic light emitting display, because the brightness of the display region 10 is set regardless of the intensities of peripheral light, light is emitted with higher brightness than required. Therefore, the power consumption of the organic light emitting display increases.

The above information disclosed in this Background section is only for enhancement of understanding of the background of the invention, and therefore it may contain information that does not form the prior art that is already known in this country to a person of ordinary skill in the art.

SUMMARY

Accordingly, embodiments of the present invention provide an organic light emitting display capable of reducing power consumption and of controlling brightness in response to the intensities of peripheral light and a method of driving the same.

In one embodiment of the present invention, there is provided an organic light emitting display including a data driver for supplying data signals to data lines, a scan driver for sequentially supplying scan signals to scan lines and sequentially supplying emission control signals to emission control lines, a display region including a plurality of pixels receiving the data signals, the scan signals and the emission control signals to display images and a brightness controller for controlling the brightness of the display region. The brightness controller controls the brightness of the display region in response to the data of one frame and the intensities of peripheral light.

The brightness controller may include a first brightness limiter for generating the first widths of an emission control signal in accordance with the magnitudes of the data of one frame, a second brightness limiter for controlling the first widths of the emission control signal in accordance with the intensities of the peripheral light to generate the second widths of the emission control signal and a brightness control signal generator to receive the second widths of the emission control signal from the second brightness limiter, to generate brightness control signals and to transmit the brightness control signals to the scan driver. The first brightness limiter includes a data summing unit for summing the data of one frame to generate sum data and to transmit at least two bit or values including the uppermost bit of the sum data to a first controller as control data, a first look up table for storing the first widths of the emission control signal corresponding to the values of the control data and the first controller for extracting the first widths of the emission control signal corresponding to the values of the control data from the first look up table to transmit the first widths of the emission control signal to the second brightness limiter. The first widths of the emission control signal stored in the first look up table are set so that the brightness of the display region is reduced as the values of the control data increase.

The second brightness limiter includes a photo sensor for sensing the intensities of the peripheral light to transmit one of at least two mode values that are previously set to a second controller and a second look up table for storing change values corresponding to the mode values. The second controller may extract the change values corresponding to the mode values from the second look up table and generate the second widths of the emission control signal using the first widths of the emission control signal and the change values to transmit the widths of the second emission control signal to the brightness control signal generator. The change values stored in the second look up table are set so that the brightness of the display region is reduced if the intensities of the peripheral light are small.

In a second embodiment of the present invention, there is provided a method of driving an organic light emitting display. The method includes summing input data to generate sum data, generating the first widths of a emission control signal in accordance with the magnitude of the sum data, controlling the first widths of the emission control signal in accordance with the intensities of peripheral light to generate the second widths of an emission control signal, generating brightness control signals corresponding to the second widths of the emission control signal and controlling the brightness of a display region in response to the brightness control signals.

The first widths of the emission control signal may be controlled so that the brightness of the display region is reduced as the values of the control data increase and so that the brightness of the display region is reduced as the intensities of the peripheral light are reduced.

BRIEF DESCRIPTION OF THE DRAWINGS

These and/or other features of the embodiments of the invention will become apparent and more readily appreciated from the following description of the embodiments of the invention, taken in conjunction with the accompanying drawings.

FIG. 6 illustrates an embodiment of the first look up table illustrated in FIG. 5.

DETAILED DESCRIPTION

Figure 1:
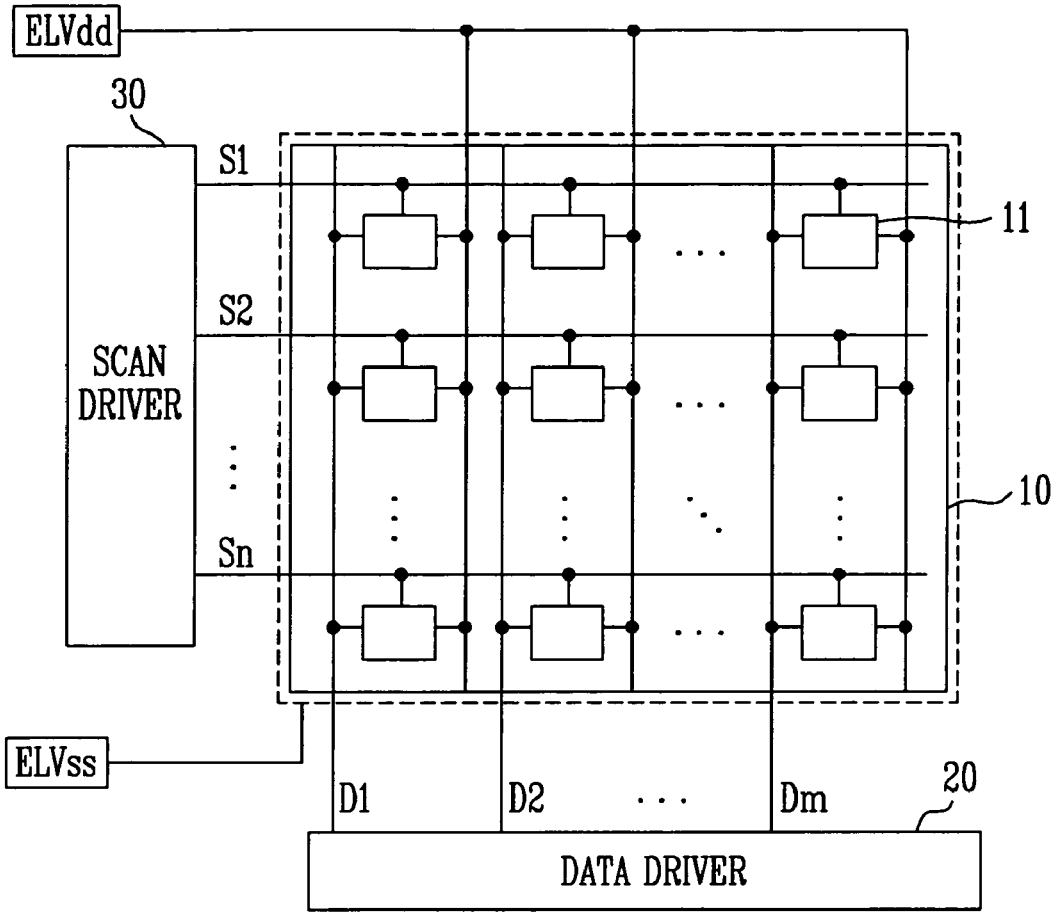
FIG. 1 (PRIOR ART)
FIG. 1 illustrates the structure of a conventional organic light emitting display.
Figure 2:
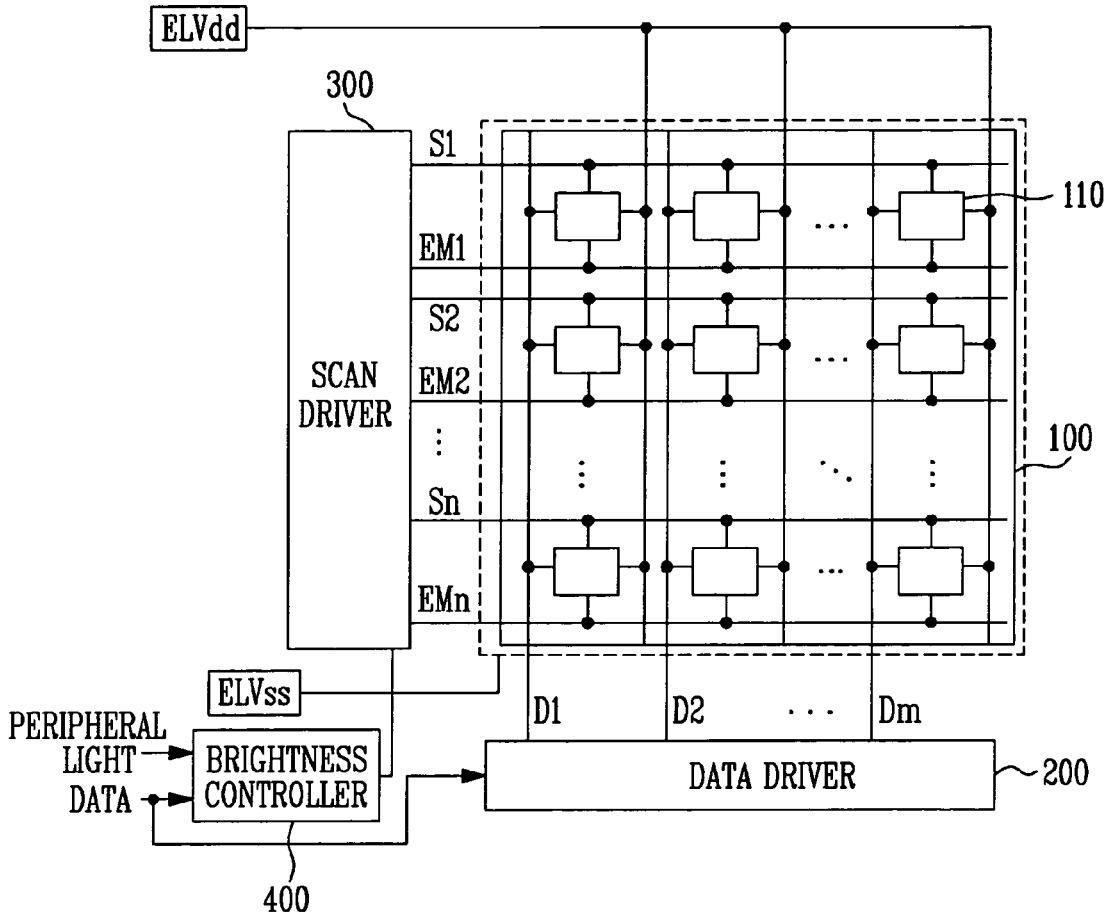
FIG. 2 illustrates the structure of an organic light emitting display according to an embodiment of the present invention.

FIG. 2 illustrates the structure of an organic light emitting display according to an embodiment of the present invention. The organic light emitting display according to the embodiment of the present invention includes a display region 100, a data driver 200, a scan driver 300 and a brightness controller 400.

The display region 100 is composed of a plurality of pixels 110 each of which includes an organic light emitting diode (OLED) (not shown). The pixels 110 are formed in the regions partitioned by scan lines S1 to Sn, emission control lines EM1 to EMn and data lines D1 to Dm. The display region 100 receives a first power source ELVdd and a second power source ELVss from the outside. Each of the pixels 110 receives a scan signal, an emission control signal, a data signal, the first power source ELVdd and the second power source ELVss to display an image.

The data driver 200 receives data DATA from the outside to generate data signals. The data signals generated by the data driver 200 are supplied to the data lines D1 to Dm in synchronization with scan signals to be transmitted to the pixels 110.

The scan driver 300 generates scan signals and emission control signals. The scan signals generated by the scan driver 300 are sequentially supplied to the scan lines S1 to Sn. The emission control signals generated by the scan driver 300 are sequentially supplied to the emission control lines EM1 to EMn. The scan driver 300 receives brightness control signals from a brightness controller 400 to generate emission control signals having widths corresponding to the brightness control signals.

The brightness controller 400 accesses the data DATA received for one frame and the intensities of the peripheral light of the display region 100 to control the brightness of the display region 100. The brightness controller 400 generates data obtained by summing the data DATA supplied for one frame. Hereinafter, the sum of the data of one frame is referred to as sum data. Here, the larger the number of pixels 110 that display high grayscales values is, the larger the value (digital value, for example bit value) of the sum data is. The smaller the number of pixels 110 that display high grayscales values is, the smaller the value of the sum data is. The brightness controller 400 that generates the sum data primarily controls the widths of the emission control signals in response to the value of the sum data. Also, the brightness controller 400 sets a mode in accordance with the intensities of the peripheral light for the display region 100 using a photo sensor that can sense the intensities of the peripheral light. The brightness controller 400 secondarily controls the widths of the emission control signals with a predetermined change value applied in accordance with the set mode. Here, the brightness of the display region 100 is controlled by the widths of the emission control signals. The term 'set' or 'sets' in reference to widths of signals may refer to establishing or defining the width of the signal. In other contexts, the term 'set' or 'sets' may refer to establishing, generating or controlling a value, setting or attribute.

The brightness controller 400 limits the widths of the emission control signals to no more than a predetermined width when the value of the sum data is set to be no less than a predetermined value. The brightness controller 400 limits the widths of the emission control signals, which are limited in accordance with the value of the sum data to no more than a predetermined width in accordance with the mode values, which are set in accordance with the intensities of the peripheral light. When the widths of the emission control signals are limited as described above, the amount of current that flows to the display region 100 is limited. Therefore, the brightness of the display region 100 is limited so that it is possible to maintain power consumption in a certain range. Also, when the brightness of the display region 100 is limited, it is possible to prevent the eyes of a user from getting tired when the user watches a screen for a long time.

The brightness controller 400 does not limit the brightness of the display region 100 when the value of the sum data is set to be no more than a predetermined value or when the intensities of the peripheral light are large so that it is possible to improve the contrast of the display region 100.

Figure 3:
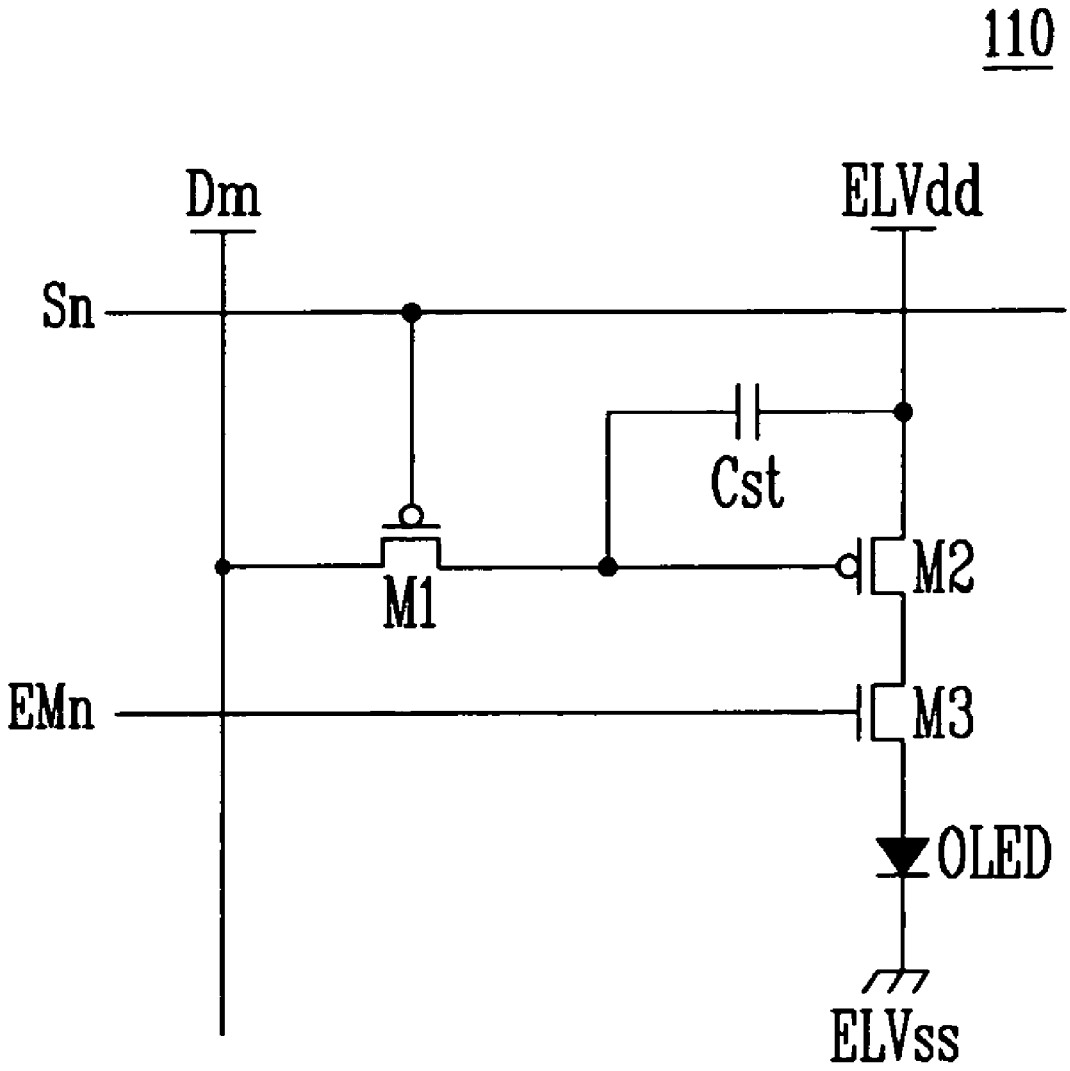
FIG. 3 illustrates an example of a pixel illustrated in FIG. 2.

FIG. 3 illustrates an example of the pixel illustrated in FIG. 2. For convenience sake, in FIG. 3, the pixel 110 connected to the nth scan line Sn, the nth emission control line EMn, and the mth data line Dm is illustrated.

Referring to FIG. 3, the pixel 110 of the organic light emitting display according to one embodiment of the present invention includes a first transistor Ml, a second transistor M2, a third transistor M3, a storage capacitor Cst and an organic light emitting diode OLED.

A first electrode of the first transistor M1 is connected to the data line Dm and the second electrode of the first transistor M1 is connected to the gate electrode of the second transistor M2 and one terminal of the storage capacitor Cst. Here, the first electrode and the second electrode are different from each other. For example, when the first electrode is a source electrode, the second electrode is a drain electrode. The gate electrode of the first transistor M1 is connected to the scan line Sn. The first transistor M1 is turned on when a scan signal is supplied to the scan line Sn to supply the data signal supplied to the data line Dm to the storage capacitor Cst. The voltage corresponding to the data signal is charged in the storage capacitor Cst.

The gate electrode of the second transistor M2 is connected to one terminal of the storage capacitor Cst and the second electrode of the first transistor M1. The first electrode of the second transistor M2 is connected to the first power source ELVdd and the other terminal of the storage capacitor Cst. The second electrode of the second transistor M2 is connected to the second electrode of the third transistor M3. The second transistor M2 supplies the current corresponding to the voltage charged in the storage capacitor Cst from the first power source ELVdd to the second electrode of the third transistor M3.

The gate electrode of the third transistor M3 is connected to the emission control line EMn. The second electrode of the third transistor M3 is connected to the second electrode of the second transistor M2 and the first electrode of the third transistor M3 is connected to the anode electrode of the OLED. The third transistor M3 is turned on when the emission control signal is supplied to enable the current from the second transistor M2 to the OLED. Since the polarity of the emission control signal is opposite to the polarity of the scan line, the conduction type of the third transistor M3 is different from the conduction type of the first and second transistors M1 and M2. For example, when the first and second transistors M1 and M2 are PMOS, the third transistor M3 is NMOS. On the other hand, the conduction type of the third transistor M3 may be the same as the conduction type of the first and second transistors M1 and M2, which will be described later.

Figure 4A:
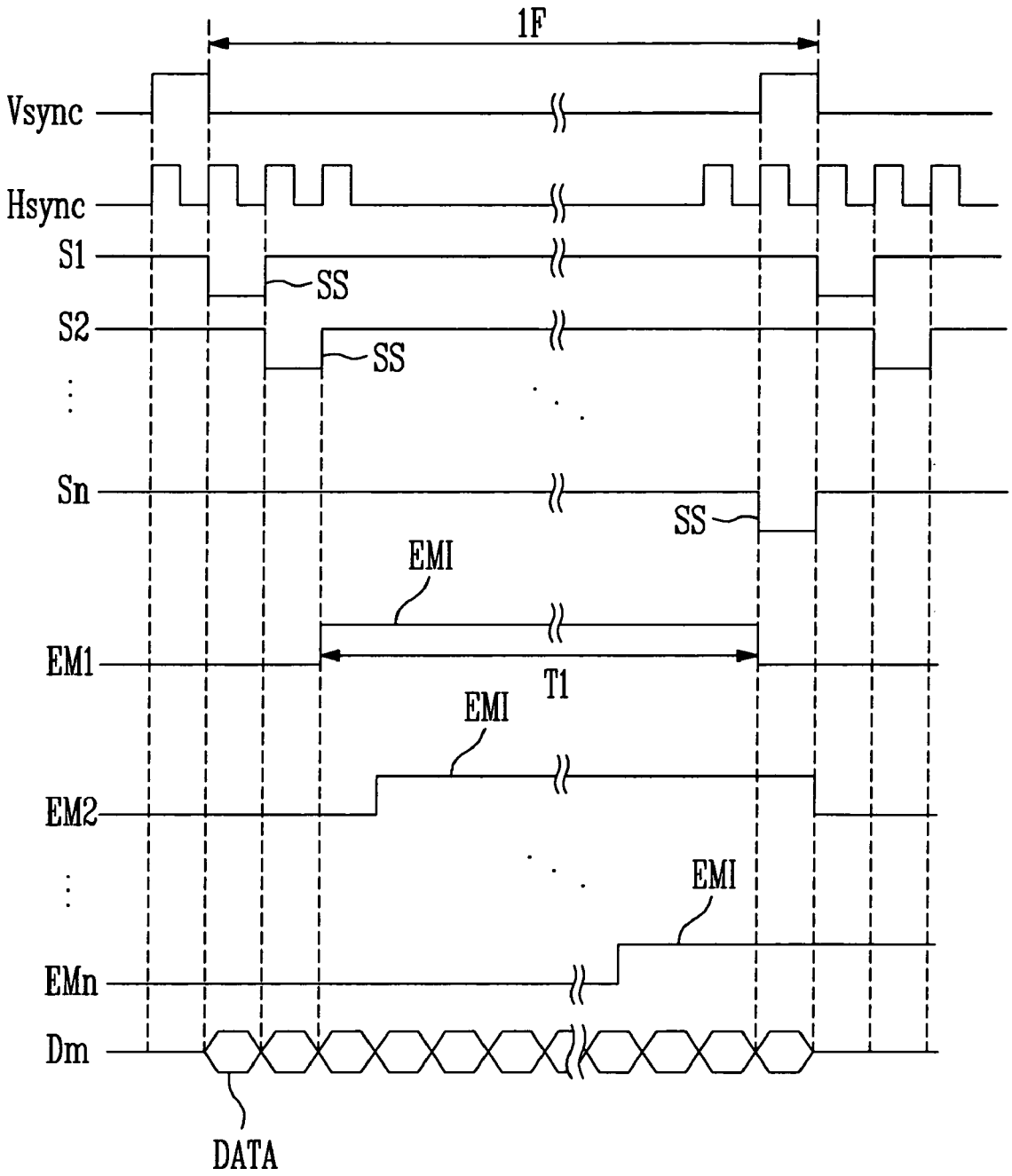
FIG. 4A illustrates waveforms that describe a method of driving the pixel illustrated in FIG. 3.
Figure 4B:
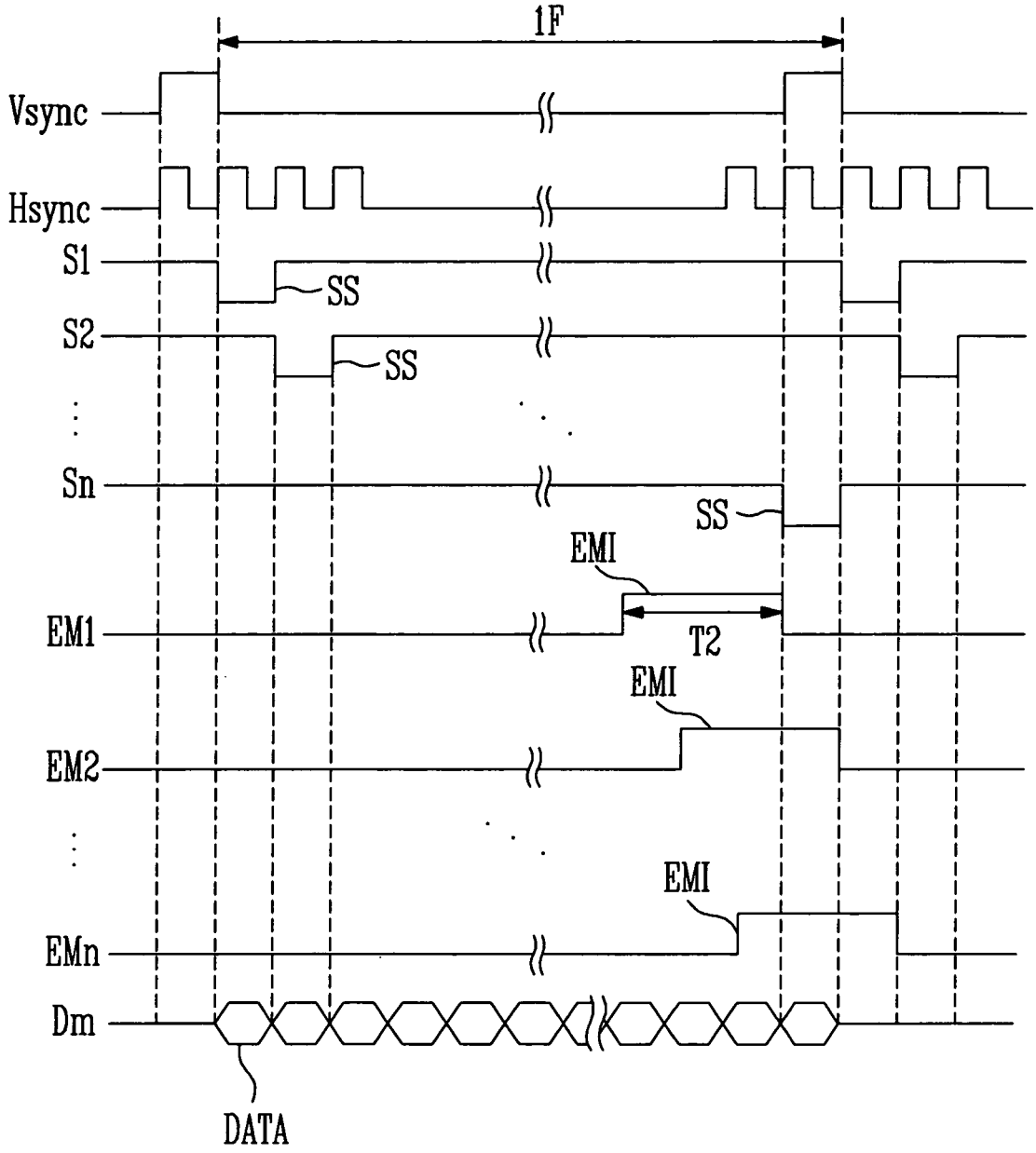
FIG. 4B illustrates waveforms that describe a method of driving the pixel illustrated in FIG. 3.

FIGS. 4A and 4B illustrate waveforms that describe a method of driving the pixel illustrated in FIG. 3. The brightness controller 400 controls brightness using the widths of the emission control signals EMI. That is, the brightness controller 400 sets the widths of the emission control signals EMI large so that the pixels 110 emit light for enough time when the value of the sum data is small and sets the widths of the emission control signals EMI small so that the brightness of the pixels 110 can be limited when the value of the sum data is large. Also, the brightness controller 400 sets the widths of the emission control signals EMI small when the intensities of peripheral light are small and sets the widths of the emission control signals EMI large when the intensities of the peripheral light are large. Because the pixel 110 illustrated in FIG. 3 is an n-type transistor turned on by the emission control signals EMI, when the widths of the emission control signals EMI are large, the emission period of the OLED in one frame 1F is long. Therefore, when the widths of the emission control signals EMI are large, a larger amount of current flows to the OLED for one frame IF so that the pixel 110 emits light for a longer time. When the value of the sum data is small or the intensities of the peripheral light are large, as illustrated in FIG. 4A, the widths of the emission control signals EMI are set as a first period T1. In the first period T1, where the emission control signals EMI are supplied, the third transistor M3 is turned on so that a predetermined current is supplied from the second transistor M2 to the OLED. Therefore, the OLED emits light in the first period T1.

When the value of the sum data is large or the intensities of the peripheral light are small, as illustrated in FIG. 4B, the brightness controller 400 sets the widths of the emission control signals EMI as a second period T2 smaller than the first period T1 so that the brightness of the pixels 110 is limited. Then, in the second period T2 where the emission control signals EMI are supplied, the third transistor M3 is turned on so that a predetermined current is supplied from the second transistor M2 to the OLED. Therefore, the OLED emits light. In this example, because the widths of the emission control signals EMI are smaller than those of the first period T1, the time for which the OLED emits light for one frame 1F is reduced. Therefore, a smaller amount of current flows to the OLED so that the brightness of the display region 100 is limited to a predetermined value. The scan signals SS, the emission control signals EMI, and the data signals DATA are generated by the scan driver 300 and the data driver 200 along with a vertical synchronizing signal Vsync and a horizontal synchronizing signal Hsync.

Figure 5:
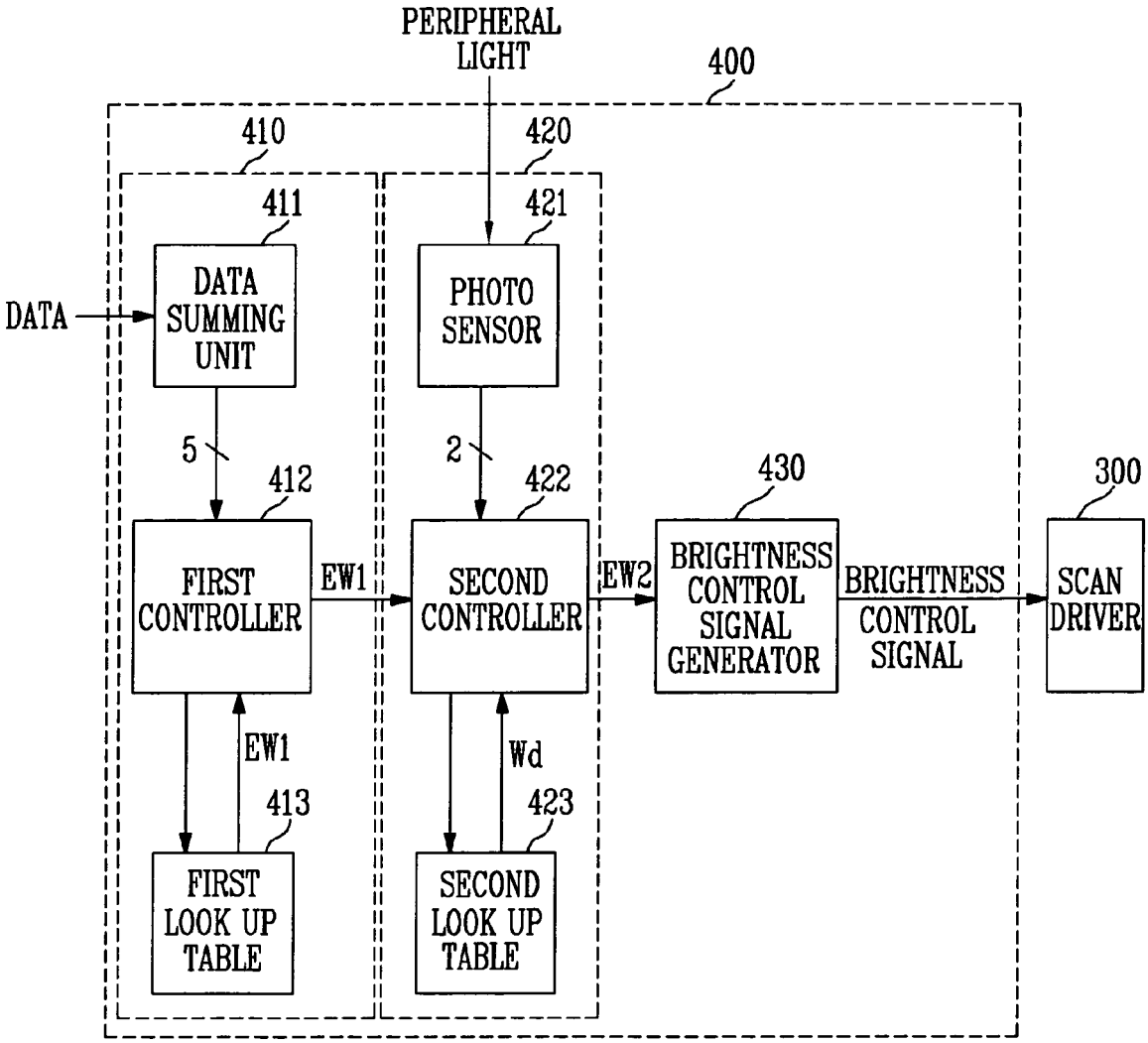
FIG. 5 illustrates an embodiment of the brightness controller illustrated in FIG. 2.

FIG. 5 illustrates an embodiment of the brightness controller illustrated in FIG. 2. The brightness controller 400 includes a first brightness limiter 410, a second brightness limiter 420 and a brightness control signal generator 430.

The first brightness limiter 410 includes a data summing unit 411, a first controller 412 and a first look up table 413.

The data summing unit 411 sums the data DATA input for one frame 1F to generate the sum data. The data summing unit 411 transmits at least two bit values (hereinafter, referred to as control data) including the uppermost bit of the sum data to the first controller 412. In one example embodiment, the values of the upper 5 bits of the sum data are transmitted. That is, the control data includes the values of 5 bits. When the value of the sum data is large, it means that a large number of data having brightness values no less than a predetermined brightness are included. When the value of the sum data is small, it means that a small number of data having brightness values no less than the predetermined brightness are included.

The first controller 412 extracts the first widths EW1 of the emission control signal from the first look up table 413 using the control data received from the data summing unit 411. Here, the first widths EW1 of the emission control signal are data values having information on the widths of the emission control signals EMI that control the emission times of the pixels 110. The first controller 412 transmits the first widths EW1 of the emission control signal to the second brightness limiter 420. Because the first controller 412 limits the brightness in accordance with the value of the sum of the data input for one frame 1F, the first controller 412 performs the function of auto brightness limit (ABL).

The first look up table 413 stores the first widths EW1 of the emission control signal corresponding to the values of the control data. Detailed description of the first look up table 413 will follow.

The second brightness limiter 420 includes a photo sensor 421, a second controller 422, and a second look up table 423.

The photo sensor 421 senses the intensities of the peripheral light of the display region 100 to set at least two modes corresponding to the intensities of the peripheral light. In one example embodiment of the present invention, the modes corresponding to the intensities of the peripheral light are set as four steps. In this example, the photo sensor 421 transmits the mode values of the four steps 0 to 3 to the second controller 422 as values of 2 bits. The photo sensor 421 sets the mode values small when the sensed intensities of the peripheral light are small and sets the mode values large when the sensed intensities of the peripheral light are large. For example, the photo sensor 421 sets the mode to 0, corresponding to "very dark," with respect to the peripheral light whose intensity is smallest and sets the mode to 3, corresponding to "outdoors," with respect to the peripheral light whose intensity is largest.

On the other hand, the photo sensor 421 may set the mode values large when the sensed intensities of the peripheral light are small and may set the mode values small when the sensed intensities of the peripheral light are large.

The second controller 422 extracts change values Wd from the second look up table 423 using the mode values received from the photo sensor 421. The second controller 422 generates the second widths EW2 of the emission control signal using the first widths EW1 of the emission control signal received from the first brightness limiter 410 and the change values Wd extracted from the second look up table 423. The second widths EW2 of the emission control signal are obtained by controlling the first widths EW1 of the emission control signal in accordance with the mode values. The second widths EW2 are data values having information on the widths of the emission control signals EMI generated by the scan driver 300. In one embodiment, the second controller 422 subtracts the change values Wd from the first widths EW1 of the emission control signal to generate the second widths EW2 of the emission control signal. Therefore, the second widths EW2 of the emission control signal may be smaller because the first widths EW1 of the emission control signal are smaller or because the change values Wd are larger. In one example, the values of the predetermined widths of the emission control signals EMI, which is to be reduced, may be stored in the second look up table 423 as the change values Wd.

In another embodiment, the second controller 422 may multiply the first widths EW1 of the emission control signal by the change values Wd to generate the second widths EW2 of the emission control signal. In this embodiment, the widths of the emission control signal EMI, which are to be changed in proportion to the first widths EW1 of the emission control signal, may be stored in the second look up table 423 as the change values Wd. Therefore, the change values Wd may be decimal values of no more than 1. Accordingly, the second widths EW2 of the emission control signal may be set to be smaller because the first widths EW1 of the emission control signal are smaller or because the change values Wd are smaller. The second controller 422 transmits the second widths EW2 of the emission control signal that are generated to the brightness control signal generator 430. Because the second controller 422 limits brightness in accordance with the intensities of the peripheral light, the second controller 422 can perform an auto brightness control (ABC) function.

The second look up table 423 stores the change values Wd corresponding to the mode values received from the second controller 422. A detailed description of the second look up table 423 will follow.

The brightness control signal generator 430 receives the second widths EW2 of the emission control signal from the second brightness limiter 420 to generate brightness control signals corresponding to the second widths EW2 of the emission control signal. The brightness control signals generated by the brightness control signal generator 430 are input to the scan driver 300. The scan driver 300 that received the brightness control signals generates the emission control signals EMI having the widths determined in accordance with the brightness control signals. Therefore, the brightness of the display region 100 is limited.

FIG. 6 illustrates an embodiment of the first look up table illustrated in FIG. 5. Actually, the contents stored in the first look up table 413 may vary in accordance with the resolution and size of the display region 100.

Referring to FIG. 6, the first widths EW1 of the emission control signal corresponding to the values of the upper 5 bits (that is, control data) of the sum data are stored in the first look up table 413. Here, the first widths EW1 of the emission control signal become smaller as the values of the control data get larger so that power consumption can be limited within a certain range (that is, so that the brightness can be limited). When the control data have at least one value including the minimum value, the first widths EW1 of the emission control signal are maintained uniform.

When the control data have values of no more than 4, the first widths EW1 of the emission control signal are equal to the 325 periods of the horizontal synchronizing signal Hsync so that the brightness is not limited. In the case where the control data have at least one value including the minimum value as described above and where the first widths EW1 of the emission control signal are not limited, contrast improves when dark images are displayed. Therefore, it is possible to display images with improved contrast.

When the control data have values no less than 5, the first widths EW1 of the emission control signal are gradually reduced according as the values of the control data increase. In the case where the control data have values larger than at least one value including the minimum value, the brightness is reduced when the first widths EW1 of the emission control signal are reduced so that it is possible to maintain power consumption within a certain range. Because the values of the control data increase as the number of pixels that display high grayscale values increases, the ratio for limiting the brightness increases.

To prevent the brightness from being excessively limited, the ratio for maximally limiting the brightness is set as 34% so that the ratio for limiting the brightness is no less than 34% even when the pixels 110 that display high grayscale values occupy most of the area of the display region 100. The look up table 413 in this case may be applied to moving images. The range in which the brightness is limited when the images displayed by the organic light emitting display are moving images is different from the range in which the brightness is limited when the images displayed by the organic light emitting display are still images. For example, in the case of still images, the ratio for maximally limiting the brightness may be 50%.

Figures 7A, 7B:
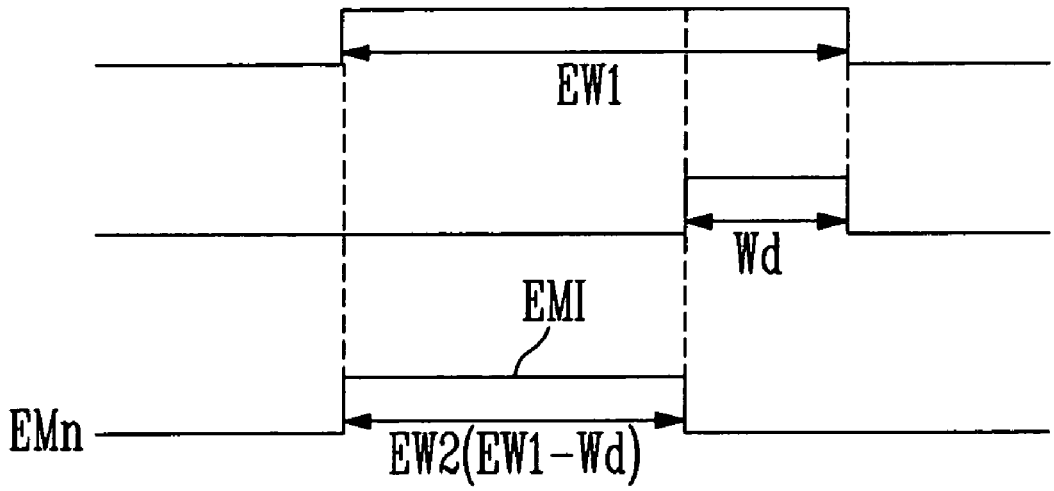
FIG. 7A illustrates a first embodiment of the second look up table illustrated in FIG. 5.
FIG. 7B illustrates waveforms that describe a method of controlling the widths of emission control signals in accordance with the second look up table illustrated in FIG. 7A.

FIG. 7A illustrates a first embodiment of the second look up table illustrated in FIG. 5. In one embodiment, the contents stored in the second look up table 423 may vary in accordance with the resolution and size of the display region 100.

Referring to FIG. 7A, the second look up table 423 stores the change values Wd corresponding to the mode values received from the second controller 422. Here, the change values Wd are obtained by expressing the widths of the emission control signals EMI that are to be reduced as values corresponding to the periods of the horizontal synchronizing signal Hsync. When the mode values are small (that is, when the intensities of the peripheral light are small), the change values Wd are set to be large. When the mode values are large (that is, when the intensities of the peripheral light are large), the change values Wd are set to be small. When the mode values are at least one value including the maximum value, the change value Wd is set as 0 so that the brightness is not limited.

When the mode value is set as 3 that is the maximum value, the change value Wd is set as 0 so that the brightness is not limited. When the mode values are at least one value including the maximum value as described above, the first widths EW1 of the emission control signal are not reduced so that the contrast improves. Therefore, it is possible to display images with improved contrast even when the intensities of the peripheral light are large.

When the mode values are set to be no more than 2, the change values Wd gradually increase as the mode values are reduced. Therefore, the second widths EW2 of the emission control signal generated by the second controller 422 are gradually reduced. In the case where the mode values are smaller than at least one value including the maximum value, when the second widths EW2 of the emission control signal are reduced, the brightness is reduced so that it is possible to maintain power consumption within a certain range. Because the mode values are smaller as the intensities of the peripheral light are smaller, the ratio for limiting the brightness increases.

FIG. 7B illustrates waveforms that describe a method of controlling the widths of the emission control signals in accordance with the second look up table illustrated in FIG. 7A.

Referring to FIG. 7B, the second widths EW2 of the emission control signal are set to be smaller than the first widths EW1 of the emission control signal by the change value Wd. For convenience sake, it is assumed that the mode value corresponding to the intensity of the peripheral light is 0 and that the first widths EW1 of the emission control signal are 320 periods of the horizontal synchronizing signal Hsync. In this example, since the change value Wd when the mode value is 0 is 30 periods of the horizontal synchronizing signal Hsync, the second widths EW2 of the emission control signal is set as 290 periods of the horizontal synchronizing signal Hsync obtained by subtracting the 30 periods of the horizontal synchronizing signal Hsync from the 320 periods of the horizontal synchronizing signal Hsync that is the first widths EW1 of the emission control signal. Therefore, the widths of the emission control signals EMI are limited by the first brightness limiter 410 and are additionally reduced by the second brightness limiter 420. That is, the second widths EW2 of the emission control signal are set to be smaller than the first widths EW1 of the emission control signal. The second widths EW2 of the emission control signal are transmitted to the brightness control signal generator 430. The brightness control signal generator 430 generates the brightness control signals corresponding to the second widths EW2 of the emission control signal to transmit the brightness control signals to the scan driver 300. The scan driver 300 that received the brightness control signals generates the emission control signals EMI having the second widths EW2 of the emission control signal to sequentially supply the emission control signals EMI to the emission control lines EMn to limit the brightness of the display region 100.

In one example, when the mode value is 3 , since the change value Wd is 0, the second widths EW2 of the emission control signal are set to be equal to the first widths EW1 of the emission control signal. In this case, the brightness of the display region 100 is not additionally limited. The brightness of the display region 100 is limited in the same manner with respect to the other mode values.

Figures 8A, 8B:
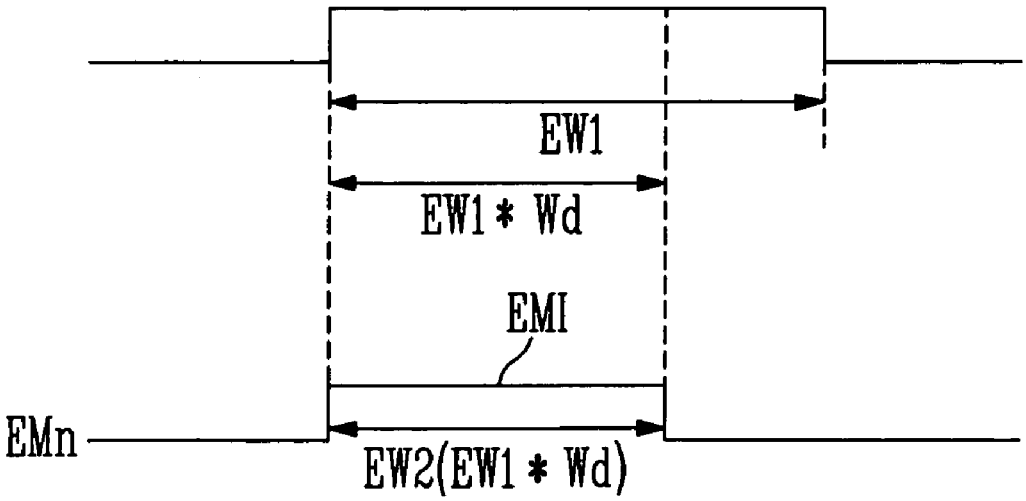
FIG. 8A illustrates a second embodiment of the second look up table illustrated in FIG. 5.
FIG. 8B illustrates waveforms that describe a method of controlling the widths of emission control signals in accordance with the second look up table illustrated in FIG. 8A.

FIG. 8A illustrates a second embodiment of the second look up table illustrated in FIG. 5. At this time, the contents stored in the second look up table 423 may vary in accordance with the resolution and size of the display region 100.

Referring to FIG. 8A, the second look up table 423 stores the change values Wd corresponding to the mode values received from the second controller 422. In this example, the change values Wd are obtained by expressing the widths of the emission control signals EMI to be changed in the ratio to the first widths EW1 of the emission control signal. Because the change values Wd are set to limit the brightness of the display region 100, the change values Wd are decimal values no more than 1. Because the second widths EW2 of the emission control signal generated by the second controller 422 are obtained by multiplying the first widths EW1 of the emission control signal by the change values Wd, the second widths EW2 of the emission control signal become smaller as the change values Wd become smaller. Therefore, the change values Wd are set to be small when the mode values are small (that is, when the intensities of the peripheral light are small) and are set to be large when the mode values are large (that is, when the intensities of the peripheral light are large). When the mode values are at least one value including the maximum value, the change value Wd is set as 1 so that the brightness is not limited.

When the mode value is set as 3 that is the maximum value, the change value Wd is set as 1 so that the brightness of the display region 100 is not limited. In the case where the mode values are at least one value including the maximum value as described above, the first widths EW1 of the emission control signal are not reduced so that contrast improves. Therefore, it is possible to display images with improved contrast even when the intensities of the peripheral light are large.

When the mode values are set to be no more than 2, the change values Wd are gradually reduced as the mode values are reduced. Therefore, the second widths EW2 of the emission control signal generated by the second controller 422 are gradually reduced. In the case where the mode values are smaller than at least one value including the maximum value as described above, when the second widths EW2 of the emission control signal are reduced, the brightness is reduced so that it is possible to maintain power consumption within a certain range. Because the mode values become smaller as the intensities of the peripheral light become smaller, the ratio for limiting the brightness increases.

FIG. 8B illustrates waveforms that describe a method of controlling the widths of the emission control signals in accordance with the second look up table illustrated in FIG. 8A.

Referring to FIG. 8B, the second widths EW2 of the emission control signal is obtained by multiplying the first widths EW1 of the emission control signal by the change value Wd. Because the change value Wd is a decimal value no more than 1, the second widths EW2 of the emission control signal is set to be smaller than or equal to the first widths EW1 of the emission control signal. For convenience sake, it is assumed that the mode value corresponding to the intensity of the peripheral light is 0 and that the first widths EW1 of the emission control signal are 320 periods of the horizontal synchronizing signal Hsync. In this example, because the change value Wd when the mode value is 0 is 0.7, the second widths EW2 of the emission control signal is set as 224 periods of the horizontal synchronizing signal Hsync, which is obtained by multiplying 0.7 by the 320 periods of the horizontal synchronizing signal Hsync that is the first widths EW1 of the emission control signal. Therefore, the widths of the emission control signals EMI may be limited by the first brightness limiter 410 and may be additionally reduced by the second brightness limiter 420. Therefore, the brightness of the display region 100 is additionally reduced.

When the mode value is 3, because the change value Wd is 1, the second widths EW2 of the emission control signal is set to be equal to the first widths EW1 of the emission control signal. In this example, the brightness of the display region 100 is not additionally limited. The brightness of the display region 100 may be limited in the same manner with respect to the other mode values.

Figure 9:
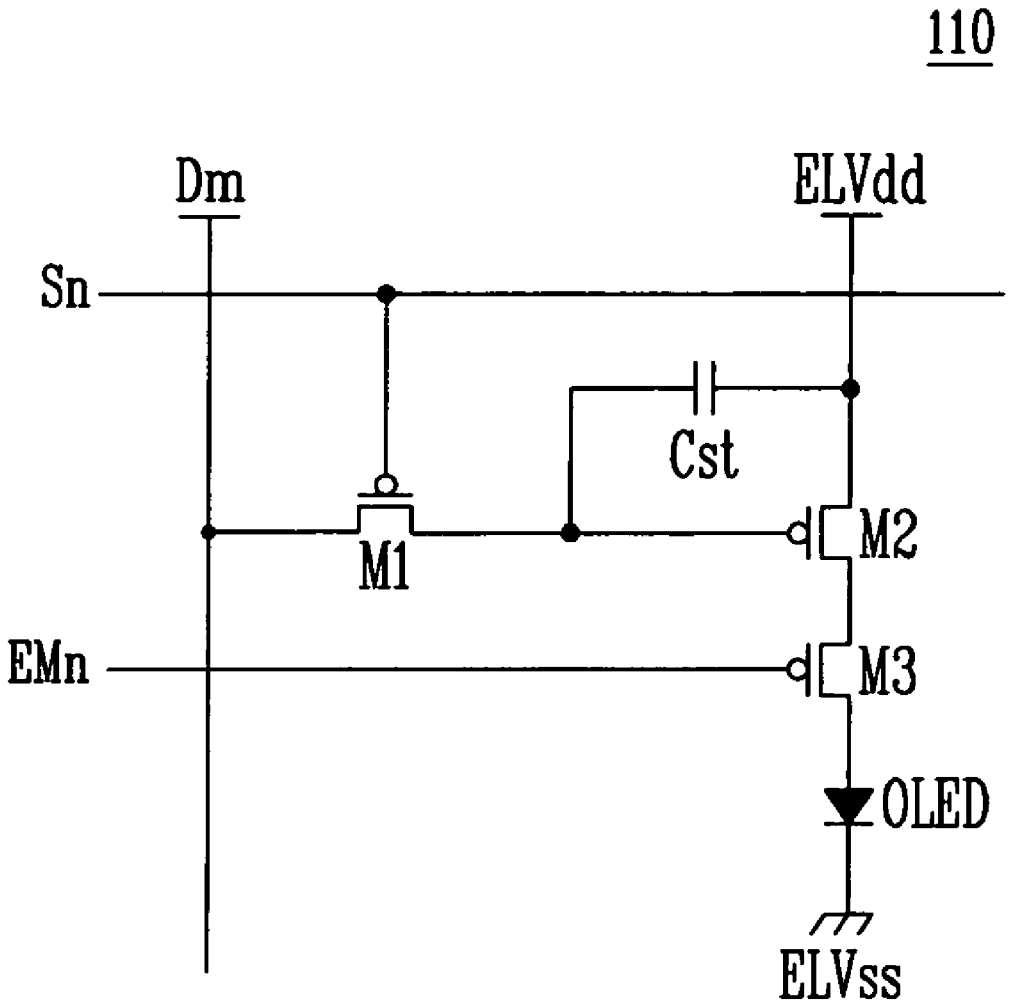
FIG. 9 illustrates another example of the pixel illustrated in FIG. 2.
Figure 10:
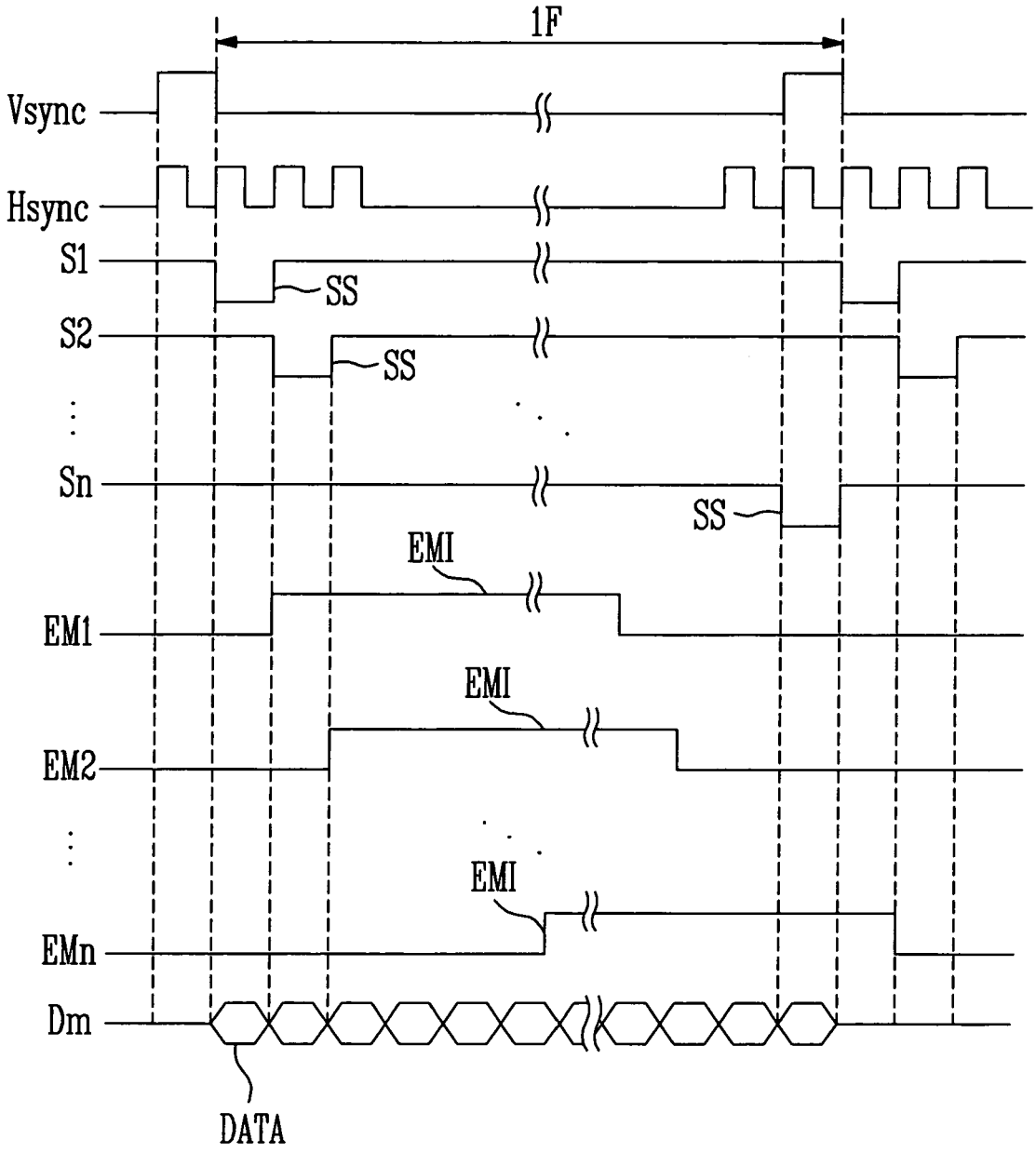
FIG. 10 illustrates waveforms that describe a method of driving the pixel illustrated in FIG. 9.

The pixel 110 of the organic light emitting display according to the present invention may have the structure illustrated in FIG. 9. Referring to FIG. 9, the conduction type of the third transistor M3 that is turned on by the emission control signal EMI may be the same as the conduction type of the first and second transistors M1 and M2. For example, the first, second, and third transistors M1, M2, and M3 may be PMOS. In this example, the operation processes illustrated in FIG. 10 are the same as the operation processes of the pixel 110 illustrated in FIGS. 3, 4A, and 4B except that the OLED emits light in the periods where the emission control signals EMI are not applied. Therefore, detailed description thereof will be omitted.

According to the embodiments of the organic light emitting display of the present invention and the method of driving the same, when the number of pixels that display high grayscales values is large in the display region, the brightness is limited so that power consumption is limited to no more than a predetermined value. When the intensities of the peripheral light on the display region are small, the brightness is additionally limited to further reduce power consumption. In this example, because the brightness is limited, it is possible to prevent the eyes of a user from becoming tired. When the number of pixels that display high grayscale values is small in the display region, the brightness is not limited so that it is possible to improve the contrast of the display region. When the intensities of the peripheral light on the display region are large, the brightness is not additionally limited so that contrast improves. Therefore, it is possible to display images with contrast improved.

Although embodiments of the present invention have been shown and described, it would be appreciated by those skilled in the art that changes might be made in the embodiments without departing from the principles and spirit of the invention, the scope of which is defined in the claims and their equivalents.

What is claimed is:

1. An organic light emitting display comprising:

a data driver for supplying data signals to data lines;

a scan driver for sequentially supplying scan signals to scan lines and sequentially supplying emission control signals to emission control lines;

a display region including a plurality of pixels adapted to receive the data signals, the scan signals and the emission control signals to display images; and a brightness controller for controlling a brightness of the display region, the brightness controller controls the brightness of the display region in response to data of one frame and intensities of peripheral light, the brightness controller includes a first brightness limiter for generating first widths of an emission control signal in accordance with a magnitude of the data of one frame, a second brightness limiter for controlling the first widths of the emission control signal in accordance with the intensities of the peripheral light, the second brightness limiter to generate second widths of the emission control signal, and a brightness control signal generator receiving the second widths of the emission control signal from the second brightness limiter, the brightness control signal generator adapted to generate brightness control signals and to transmit the brightness control signals to the scan driver.

2. The organic light emitting display as claimed in claim 1, wherein the first brightness limiter comprises:

a data summing unit for summing the data of one frame to generate sum data and to transmit at least two bit values including an uppermost bit of the sum data to a first controller as control data; and a first look up table for storing the first widths of the emission control signal corresponding to values of the control data, wherein the first controller extracts the first widths of the emission control signal corresponding to the values of the control data from the first look up table to transmit the first widths of the emission control signal to the second brightness limiter.

3. The organic light emitting display as claimed in claim 2, wherein the first widths of the emission control signal stored in the first look up table are defined so that the brightness of the display region is reduced as the values of the control data increase.

4. The organic light emitting display as claimed in claim 3, wherein the first widths of the emission control signal stored in the first look up table are reduced as the values of the control data increase.

5. The organic light emitting display as claimed in claim 4, wherein when the control data have at least one value including a minimum value, the first widths of the emission control signal stored in the first look up table are maintained uniform.

6. The organic light emitting display as claimed in claim 1, wherein the second brightness limiter comprises:

a photo sensor for sensing the intensities of the peripheral light, the photo sensor to transmit one of at least two mode values that have been previously defined to a second controller; and a second look up table for storing change values corresponding to the mode values, wherein the second controller extracts the change values corresponding to the mode values from the second look up table and generates the second widths of the emission control signal using the first widths of the emission control signal and the change values to transmit the second widths of the emission control signal to the brightness control signal generator.

7. The organic light emitting display as claimed in claim 6, wherein the second look up table stores a predetermined width as the change value.

8. The organic light emitting display as claimed in claim 7, wherein the second controller subtracts the change values from the first widths of the emission control signal to generate the second widths of the emission control signal.

9. The organic light emitting display as claimed in claim 7, wherein the change values stored in the second look up table are defined so that the brightness of the display region is reduced if the intensities of the peripheral light are small.

10. The organic light emitting display as claimed in claim 9, wherein if a mode value is established at a maximum intensity of peripheral light, the brightness of the display region is not reduced.

11. The organic light emitting display as claimed in claim 6, wherein the second look up table stores a decimal value no more than 1 as a change value.

12. The organic light emitting display as claimed in claim 11, wherein the second controller multiplies the first widths of the emission control signal by the change value to generate the second widths of the emission control signal.

13. The organic light emitting display as claimed in claim 11, wherein the change values stored in the second look up table are defined so that the brightness of the display region is reduced if the intensities of the peripheral light are small.

14. The organic light emitting display as claimed in claim 13, wherein if the mode value is established at a maximum intensity of peripheral light, the brightness of the display region is not reduced.

15. The organic light emitting display as claimed in claim 1, wherein the scan driver controls widths of emission control signals via the brightness control signals.

* * * * *